US010266317B1

(12) United States Patent
Bores

(10) Patent No.: US 10,266,317 B1
(45) Date of Patent: Apr. 23, 2019

(54) REMOVABLE CLOSURE WITH A KEY CODE BODY FOR A FLUID CONTAINER

(71) Applicant: Entegris, Inc., Billerica, MA (US)

(72) Inventor: Gregory Bores, Prior Lake, MN (US)

(73) Assignee: Entegris, Inc., Billerica, MA (US)

( * ) Notice: Subject to any disclaimer, the term of this patent is extended or adjusted under 35 U.S.C. 154(b) by 0 days.

(21) Appl. No.: 15/826,347

(22) Filed: Nov. 29, 2017

(51) Int. Cl.
*B65D 51/24* (2006.01)
*B65D 41/04* (2006.01)
*B65D 51/18* (2006.01)

(52) U.S. Cl.
CPC ..... *B65D 51/245* (2013.01); *B65D 41/0492* (2013.01); *B65D 51/18* (2013.01)

(58) Field of Classification Search
CPC ..... B65D 39/16; B65D 5/748; B65D 55/14; B65D 1/0246; B65D 1/023; B65D 41/0492; B65D 41/04; B65D 50/046; B65D 50/041; B65D 50/068; B65D 51/245; B65D 51/24; B65D 51/18
USPC ... 220/230, 212, 254.8, 259.3, 256.1, 254.1, 220/210, 254.7, 319, 315, 257.2, 257.1; 215/230, 228, 216, 217, 215, 201, 44, 215/329, 316, 297, 296, 295; 206/459.1, 206/459.5
See application file for complete search history.

(56) References Cited

U.S. PATENT DOCUMENTS 2,226,390 A * 12/1940 Rosevear, Jr. ..... B65D 55/145 215/206
2,587,147 A * 2/1952 Guion ..... A61J 7/04 116/308
2,625,303 A * 1/1953 Mays ..... B65D 55/14 137/385
3,033,406 A 5/1962 Sauber
3,151,599 A * 10/1964 Livingston ..... A61J 7/04 116/308
3,454,177 A * 7/1969 Bloom ..... B65D 51/2814 206/222
4,138,029 A * 2/1979 Mahoney ..... B65D 51/145 206/459.1
4,238,033 A 12/1980 Artzt
(Continued)

FOREIGN PATENT DOCUMENTS

KR 2000208890000 1/1982

OTHER PUBLICATIONS

International Search Report and Written Opinion in International Application No. PCT/US2018/062822 dated Mar. 14, 2019.

*Primary Examiner* — Robert J Hicks
(74) *Attorney, Agent, or Firm* — Entegris, Inc.

(57) ABSTRACT

A cap for a fluid container includes a cap body including a base surface at a first end and an opening at a second end. The cap body is engageable with the fluid container. The base surface includes a first engagement structure. The cap includes a first aperture in the base surface. The cap further includes a key code body including a second engagement structure engageable with the first engagement structure. The key code body includes a key code ring. A removable closure member includes a plurality of engagement surfaces and a sealing surface disposed opposite the plurality of engagement surfaces. The removable closure member includes a sealing mechanism including a sealing member on the sealing surface. The sealing member is engageable with a portion of the base surface that defines the first aperture.

20 Claims, 13 Drawing Sheets

(56) References Cited

U.S. PATENT DOCUMENTS

| | | | | | |
|---|---|---|---|---|---|
| 4,345,541 | A * | 8/1982 | Villa-Real | A61J 7/04 | 116/308 |
| 4,365,722 | A * | 12/1982 | Kramer | A61J 7/04 | 116/308 |
| 4,399,924 | A | 8/1983 | Nilsson | | |
| 5,115,929 | A * | 5/1992 | Buono | B65D 50/041 | 215/216 |
| 5,279,422 | A * | 1/1994 | Adams | A61J 7/04 | 116/308 |
| 5,299,701 | A * | 4/1994 | Barker | A61J 7/04 | 215/216 |
| 6,003,467 | A * | 12/1999 | Shelton-Ferrell | G09F 11/23 | 116/308 |
| 8,857,617 | B2 * | 10/2014 | Balakier | A61J 7/04 | 206/528 |
| 2010/0147732 | A1 | 6/2010 | Delagrange | | |
| 2018/0178955 | A1 * | 6/2018 | West | B65D 51/245 | |
| 2018/0250196 | A1 * | 9/2018 | Warden | B65D 50/04 | |

* cited by examiner

REMOVABLE CLOSURE WITH A KEY CODE BODY FOR A FLUID CONTAINER

FIELD

This disclosure relates generally to an enclosure for containing a fluid. More specifically, the disclosure relates to a cap and closure system, method, and component for containing a fluid.

BACKGROUND

Some manufacturing processes utilize liquid chemicals. The liquid chemicals may include, for example, acids, solvents, bases, photoresists, dopants, inorganic solutions, organic solutions, pharmaceuticals, or the like. In using such chemicals, a containment system may be utilized to properly contain the chemicals during storage, transport, and ultimately during the manufacturing process itself.

SUMMARY

This disclosure relates generally to an enclosure for containing a fluid. More specifically, the disclosure relates to a cap and closure system, method, and component for containing a fluid.

A cap for a fluid container is disclosed. The cap includes a cap body including a base surface at a first end and an opening at a second end. The cap body is engageable with the fluid container. The base surface includes a first engagement structure protruding in a longitudinal direction from the base surface. The cap includes a first aperture in the base surface. The cap further includes a key code body including a second engagement structure engageable with the first engagement structure that secures the key code body to the cap body in an engaged state. The key code body includes a key code ring at a first end of the key code body. The key code ring includes a shoulder such that a portion of the key code ring is disposed spaced from the base surface when the cap body and the key code body are in the engaged state. The portion of the key code ring that is spaced from the base surface includes a first surface. The cap further includes a removable closure member including a plurality of engagement surfaces and a sealing surface disposed opposite the plurality of engagement surfaces. The plurality of engagement surfaces is engageable with the first surface to provide a closing force that maintains the sealing surface in engagement with the base surface in the engaged state. The removable closure member includes a sealing mechanism including a sealing member on the sealing surface. The sealing member is engageable with a portion of the base surface that defines the first aperture.

A containment system for containing a liquid is also disclosed. The containment system includes a container configured to store a fluid; and a cap engageable with the container. The cap includes a cap body including a base surface at a first end and an opening at a second end. The cap body includes threads engageable with threads of the fluid container. The threads are disposed between the second end and the first end. The base surface includes a first engagement structure protruding in a longitudinal direction from the base surface. The cap includes a first aperture in the base surface. The cap further includes a key code body including a second engagement structure engageable with the first engagement structure that secures the key code body to the cap body in an engaged state. The key code body includes a key code ring at a first end of the key code body. The key code ring includes a shoulder such that a portion of the key code ring is disposed spaced from the base surface when the cap body and the key code body are in the engaged state. The portion of the key code ring that is spaced from the base surface includes a first surface. The cap further includes a removable closure member including a plurality of engagement surfaces and a sealing surface disposed opposite the plurality of engagement surfaces. The plurality of engagement surfaces is engageable with the first surface to provide a closing force that maintains the sealing surface in engagement with the base surface in the engaged state. The removable closure member includes a sealing mechanism including a sealing member on the sealing surface. The sealing member is engageable with a portion of the base surface that defines the first aperture.

A fluid storage kit is also disclosed. The fluid storage kit includes a containment system for containing a liquid. The containment system includes a container configured to store a fluid; and a cap engageable with the container. The cap includes a cap body including a base surface at a first end and an opening at a second end. The cap body includes threads engageable with threads of the fluid container. The threads are disposed between the second end and the first end. The base surface includes a first engagement structure protruding in a longitudinal direction from the base surface. The cap includes a first aperture in the base surface. The cap further includes a key code body including a second engagement structure engageable with the first engagement structure that secures the key code body to the cap body in an engaged state. The key code body includes a key code ring at a first end of the key code body. The key code ring includes a shoulder such that a portion of the key code ring is disposed spaced from the base surface when the cap body and the key code body are in the engaged state. The portion of the key code ring that is spaced from the base surface includes a first surface. The cap further includes a removable closure member including a plurality of engagement surfaces and a sealing surface disposed opposite the plurality of engagement surfaces. The plurality of engagement surfaces is engageable with the first surface to provide a closing force that maintains the sealing surface in engagement with the base surface in the engaged state. The removable closure member includes a sealing mechanism including a sealing member on the sealing surface. The sealing member is engageable with a portion of the base surface that defines the first aperture.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

This disclosure relates generally to an enclosure for containing a fluid. More specifically, the disclosure relates to a cap and closure system, method, and component for containing a fluid.

Some manufacturing processes utilize liquid chemicals. The liquid chemicals may include, for example, acids, solvents, bases, photoresists, dopants, inorganic solutions, organic solutions, pharmaceuticals, or the like. In using such chemicals, a containment system may be utilized to properly contain the chemicals during storage, transport, and ultimately during the manufacturing process itself.

Embodiments of this disclosure are directed to a cap for a fluid container, containment system, fluid storage kit, and methods of assembling thereof. The cap for the fluid container can be used to seal the fluid container until an appropriate time at which the stored fluid may be used in a manufacturing process. As the fluids stored in the fluid container may be specialized for a particular use, it is critical that the proper fluid be used at the appropriate time. If the incorrect fluid is used, there may be risk to the manufacturing personnel, contamination, damage to the article(s) being manufactured, combinations thereof, or the like. Accordingly, in an embodiment it may be beneficial for the cap to be encoded such that the manufacturing personnel, shipping personnel, etc., can easily identify the fluid stored in the fluid container. Additionally, some of the manufacturing processes are performed in a clean room. In such environments, the article(s) being manufactured may be contaminated, damaged, or a combination thereof, if the cap includes a breakaway portion via which the fluid is dispersed. Embodiments of this disclosure provide a removable closure member for the cap that can be engaged with or removed from the cap without damaging any material of the cap, thereby reducing a likelihood of contamination, damage to the article(s) being manufactured, or a combination thereof.

A fluid includes, but is not limited to, a substance that flows or deforms when a shear stress is applied. A fluid can include, for example, a liquid.

Figure 1A:
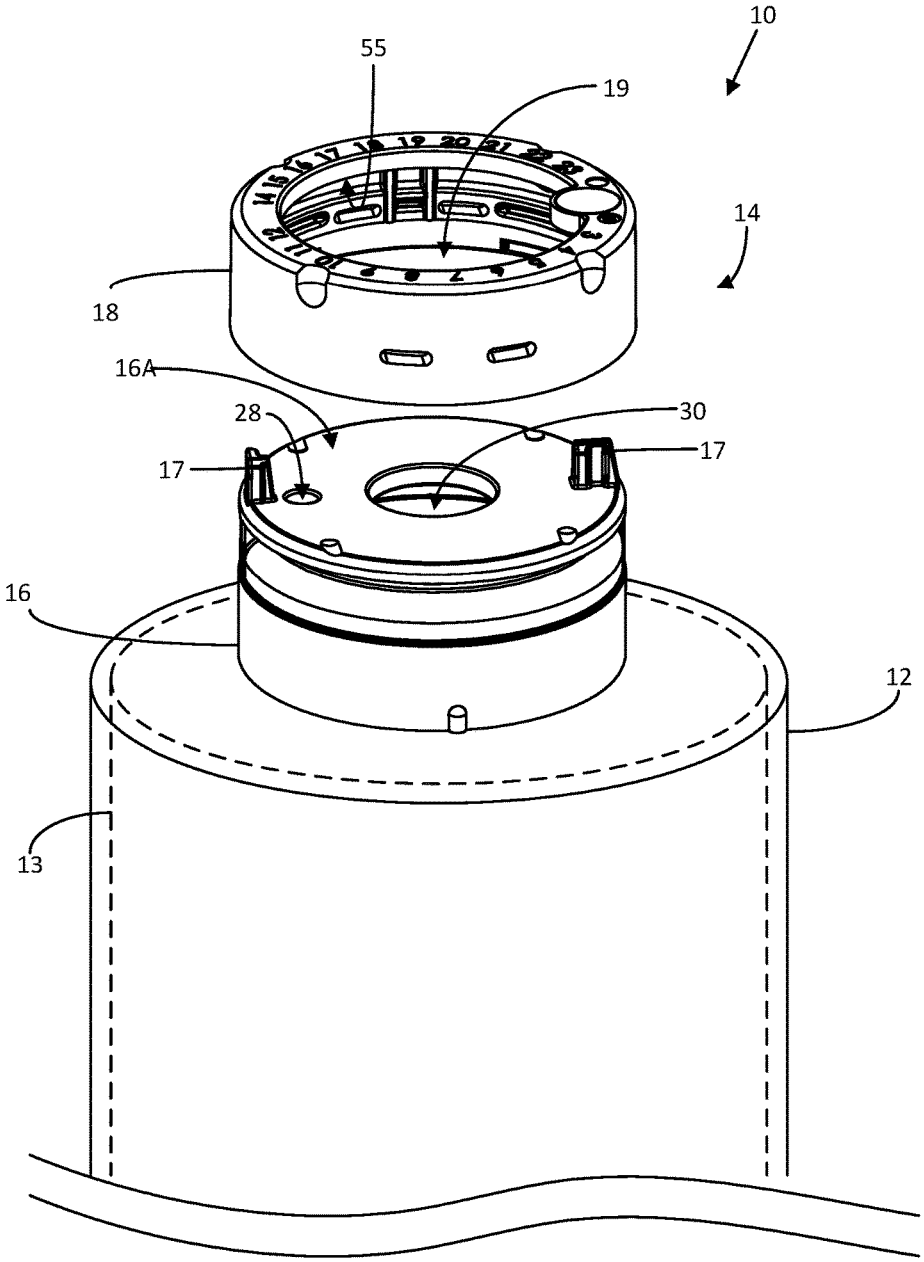
FIG. 1A is a schematic view of a fluid containment system, according to an embodiment.

FIG. 1A is a schematic view of a fluid containment system 10, according to an embodiment. The fluid containment system 10 can generally be used for containing a fluid such as a liquid suitable for use in, for example, manufacturing such as, but not limited to, semiconductor manufacturing or the like. As such, the fluid containment system 10 can be configured to store a liquid such as a liquid chemical including, but not limited to, photoresist for use in the manufacturing of integrated circuits or the like. It will be appreciated that the fluid containment system 10 can store liquids including liquid chemicals other than photoresist such as, but not limited to, acids, solvents, bases, dopants, inorganic solutions, organic solutions, pharmaceuticals, or the like.

The fluid containment system 10 includes a container 12. In an embodiment, the container 12 can include a bag-in-bottle or bag-in-can style container. Such a container may include an inner container 13 or liner disposed within the container 12 that is made of a relatively flexible material, while the container 12 is made of a relatively more rigid material. In an embodiment, the container 12 can be made of, for example, polyolefins such as, but not limited to, polypropylene, high-density polyethylene, linear low-density polyethylene, or the like. It will be appreciated that the materials are examples and that the actual materials for the container 12 can vary beyond the stated list within the principles of this disclosure.

A cap 14 is engageable with the container 12. The cap 14 can be installed to, for example, store the fluid within the container 12. It will be appreciated that the cap 14 can be secured to the container 12 even when there is no fluid stored in the container 12. The cap 14 can be an assembly that includes multiple components. In the illustrated embodiment, the cap 14 includes a cap body 16 and a key code body 18.

The cap body 16 is engageable with the container 12 to secure the cap 14 to the container 12. For example, in an embodiment, the container 12 can be threaded and the cap body 16 can have corresponding threading configured to engage with the threads of the container 12. In an embodiment, the cap body 16 can be cylindrical. The cap body 16 can include a base surface 16A. The base surface 16A can be open in a plurality of locations via an aperture 28 and an aperture 30. The apertures 28 and 30 may enable a fluid communication across the base surface 16A. For example, the fluid stored in the inner container 13 can be provided from the aperture 30. In an embodiment, the aperture 28 may be disposed such that it is located in communication with a space between the container 12 and the inner container 13. In an embodiment this can, for example, enable a pressure differential which can assist in dispensing the fluid from the inner container 13.

The key code body 18 is engageable with the cap body 16 to secure the key code body 18 to the cap body 16. For example, in an embodiment, alignment features 17 can extend from the base surface 16A of the cap body 16. The alignment features 17 can be used to align the key code body 18 and the cap body 16. In an embodiment, the key code body 18 and the cap body 16 may be secured together by, for example, a snap-fit connection or the like. Two alignment features 17 are shown in the illustrated embodiment. It will be appreciated that a number of alignment features 17 can vary. For example, in an embodiment, there may be three or more alignment features 17. In another embodiment, there may be a single alignment feature 17. A geometry of the alignment features 17 is not intended to be limited to that shown in FIG. 3 and can vary so long as a recess on the key code body 18 is configured to receive the corresponding alignment features 17. In an embodiment, the key code body 18 can be a cylindrical ring-like structure. The key code body 18 can have an opening 19 therethrough. An end of the key code body 18 disposed relatively away from the cap body 16 when in an assembled configuration can include a shoulder 55. The shoulder 55 can be referred to as, for example, a lateral protrusion from the key code body 18. The shoulder 55 can generally provide a surface for receiving a removable closure member (see FIG. 1B-11 below). The shoulder 55 is shown and described in additional detail in accordance with FIG. 5 below.

The cap 14, including the cap body 16 and the key code body 18, can be made of a same material as or similar material to the materials of the container 12. In an embodiment, the cap body 16 and the key code body 18 can be made of, for example, polyolefins such as, but not limited to, polypropylene, high-density polyethylene, linear low-density polyethylene, or the like. Other non-limiting example of polymers suitable for making various embodiments of the cap 14, including the cap body 16 and the key code body 18, include fluoropolymers, polyesters, polycarbonates and polyamides. It will be appreciated that the materials are examples and that the actual materials for the cap body 16 and the key code body 18 can vary beyond the stated list within the principles of this disclosure. In an embodiment, a material of the cap body 16 is the same as a material of the key code body 18. In another embodiment, the material of the cap body 16 can be different from the material of the key code body 18. In a further embodiment, a material of the cap body 16 and the key code body 18 is the same as a material of the container 12. In an embodiment, the material of the cap body 16 and the key code body 18 is a different material from the container 12. The cap 14, cap body 16, and key code body 18 are described in additional detail in accordance with FIGS. 2-11 below.

Figure 1B:
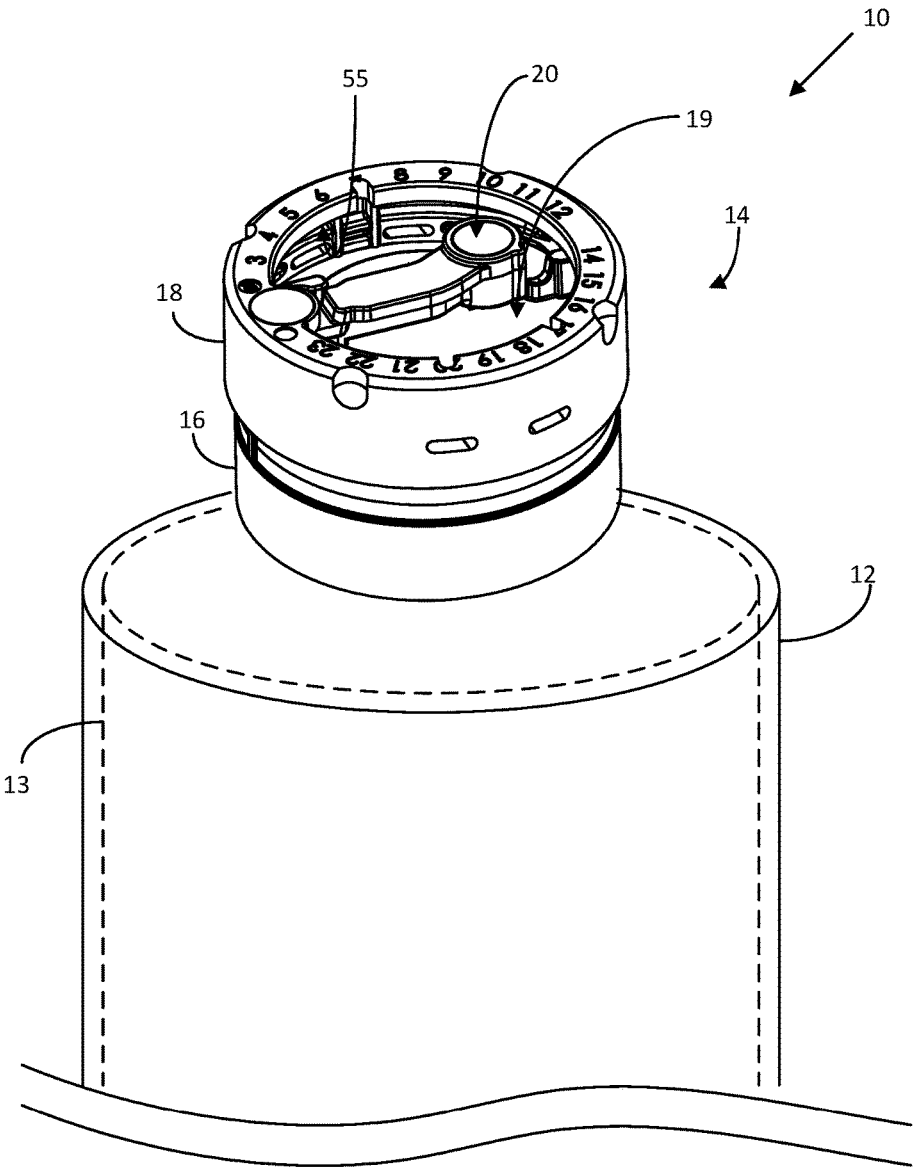
FIG. 1B is a schematic view of the fluid containment system in FIG. 1A including a removable closure member, according to an embodiment.

FIG. 1B is an alternative schematic view of the fluid containment system 10 in FIG. 1A including a removable closure member 20, according to an embodiment. FIG. 1B shows the cap 14 in an assembled configuration instead of in the exploded view of FIG. 1A.

The removable closure member 20 may be used to seal the aperture 28 and to provide additional sealing strength for the aperture 30.

In the illustrated embodiment, the removable closure member 20 is shown in an engaged state in which the removable closure member 20 is engaged with the key code body 18. In unengaged state (not shown in FIG. 1B), the removable closure member 20 may be installed in the opening 19 of the key code body 18, but the removable closure member 20 may be in an unlocked state in which the removable closure member 20 is removable from the key code body 18. In an unengaged state, the removable closure member 20 may be removed from the opening 19 of the key code body 18. Note that FIG. 1A, which does not show the removable closure member 20, is representative of the unengaged state. A design of the removable closure member 20 can vary. Examples of the removable closure member 20 are described in additional detail in accordance with FIGS. 2-11 below.

The removable closure member 20 can be made of a same material as or similar material to the materials of the container 12. In an embodiment, the removable closure member 20 can be made of, for example, polyolefins such as, but not limited to, polypropylene, high-density polyethylene, linear low-density polyethylene, or the like. Other non-limiting examples of polymers suitable for the closure member 20 include fluoropolymers, polyesters, polycarbonates and polyamides. It will be appreciated that the materials are examples and that the actual materials for the removable closure member 20 can vary beyond the stated list within the principles of this disclosure.

Figure 2:
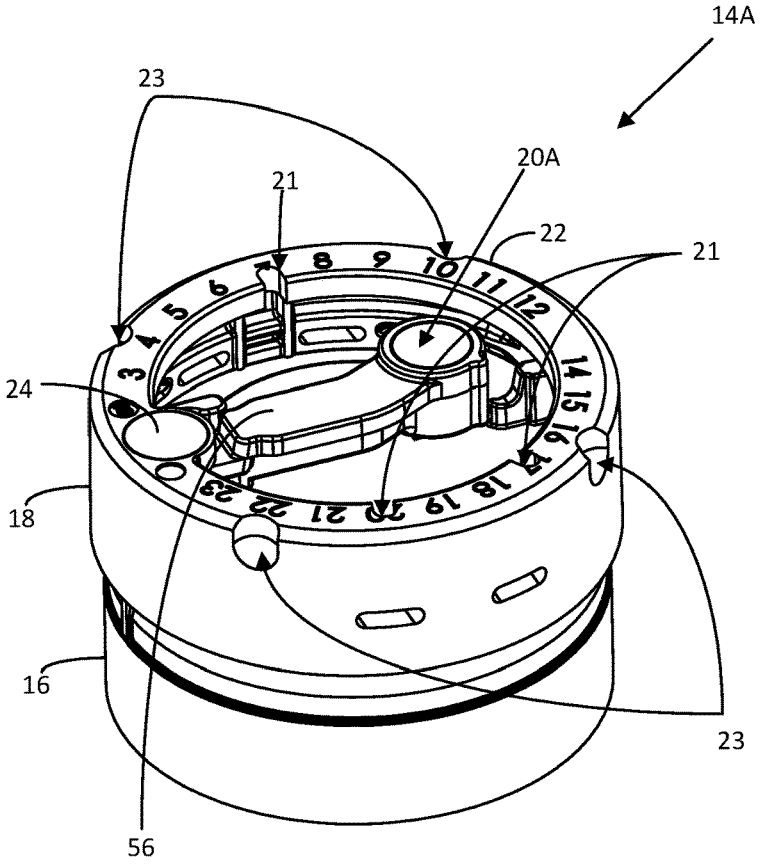
FIG. 2 is a perspective view of a cap for a fluid containment system, according to an embodiment.

FIG. 2 is a perspective view of a cap 14A for a fluid containment system (e.g., the fluid containment system 10 in FIGS. 1A, 1B), according to an embodiment. The cap 14A can be utilized as the cap 14 in the fluid containment system 10 of FIGS. 1A, 1B. Features of FIG. 2 can be the same as or similar to features of FIGS. 1A, 1B. For simplicity of this disclosure, features which have previously been described will not be described in additional detail.

The cap 14A generally includes a cap body 16 and a key code body 18. The cap 14A further includes a removable closure member 20A. In the illustrated embodiment, the removable closure member 20A is shown in an engaged state. In the engaged state, the removable closure member 20A may be inserted in a central area of the key code body 18 and locked into place, thereby forming a sealing connection with the cap body 16.

The cap 14A further includes a key code ring 22. The key code ring 22 includes a plurality of numbers. The numbers can, for example, be utilized to identify a chemical and a vendor for a particular cap 14A. The key code ring 22 can include a plurality of female access points 23 for a tool such as, but not limited to, a wrench, a torque wrench, or the like.

Still referring to FIG. 2, the key code ring 22 may define the shoulder 55 (shown and described further with respect to FIG. 5) of the cap 14A and can include a plurality of female key code recesses 21 formed at an inner diameter of the key code ring 22. The key code recesses 21 can be aligned with a plurality of protrusions on a dispensing device if the proper dispensing device is being used. Accordingly, the cap 14A may be configured to indicate a specific kind or class of liquids for being stored in the assembly such as photoresist, to enable only certain dispensing heads to mate with the fluid containment system 10, or a combination thereof. In use, the key code recesses 21 may be configured to mate with a particular dispensing device or with certain subsets of photoresist bottles. In an embodiment, this can prevent against inadvertently connecting the wrong type of liquid to a cap. Some containers may be universally applied to any cap. It will be appreciated that a geometry of the cap 14A and key code ring 22 can vary. It will also be appreciated that the key code recesses 21 could alternatively be key code protrusions configured to mate with recesses on the dispensing device.

A magnet 24 is disposed on the key code ring 22. The magnet 24 may be utilized during a manufacturing process in which the fluid stored in the fluid containment system (e.g., fluid containment system 10) is dispensed. When a fluid dispensing system (not shown) that is part of the manufacturing process is properly aligned, the magnet 24 can be used to provide a particular signal via one or more sensors on the dispensing equipment to indicate that a proper connection is identified. If the dispensing equipment does not align with the magnet 24, then a different signal (or no signal) can be provided via one or more sensors on the dispensing equipment to indicate that a proper connection has not been identified.

Figure 3:
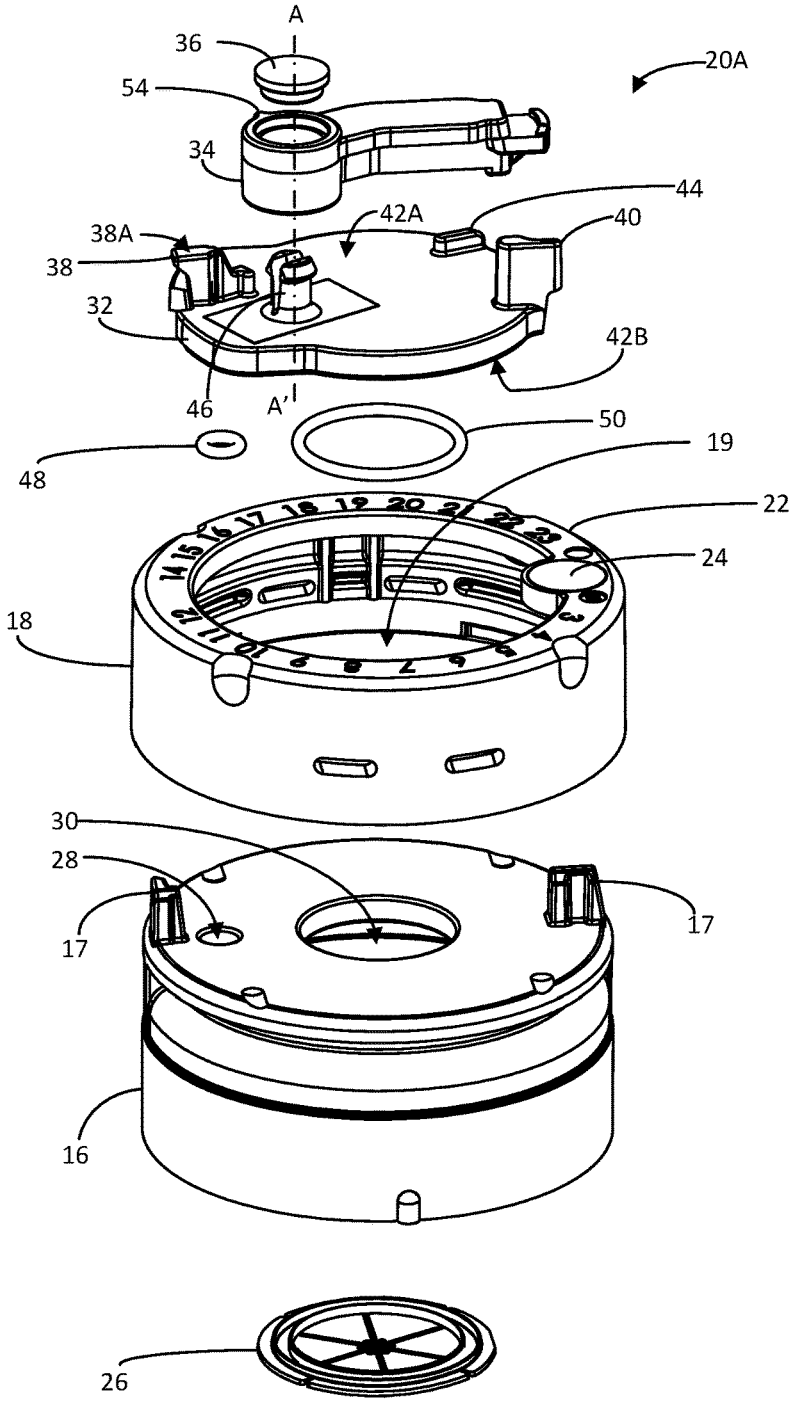
FIG. 3 is an exploded perspective view of the cap of FIG. 2 for a fluid containment system, according to an embodiment.

FIG. 3 is an exploded perspective view of the cap 14A of FIG. 2 for a fluid containment system (e.g., the fluid containment system 10 in FIGS. 1A, 1B), according to an embodiment. Features of FIG. 3 can be the same as or similar to features of FIGS. 1A-2. For simplicity of this disclosure, features which have previously been described will not be described in additional detail.

The cap 14A further includes a seal 26. The seal 26 can be disposed between the inner container 13 (FIGS. 1A, 1B) and the removable closure member 20A. The seal 26 is shown as circular in geometry. It will be appreciated that a size and shape of the seal 26 can vary according to a size and shape of an aperture 30 of the cap body 16. In an embodiment, the seal 26 can be a rupturable seal. Accordingly, during manufacturing, dispensing equipment can be utilized to rupture the seal 26 at a time in which the fluid is to be dispensed. In an embodiment, the seal 26 may not be a rupturable seal. In such an embodiment, the seal 26 may be disposed in a different location, such as on the removable closure member 20A. The seal 26 may alternatively be referred to as a breakaway seal, a break seal, or the like. The seal 26 may be secured to the cap body 16, according to an embodiment. For example, the seal 26 may be secured to an underside of the cap body 16. A material of the seal 26 can be selected based on, for example, a type of material that is going to be stored in the inner container 13.

In an embodiment, the cap body 16 includes one or more apertures 28, 30. In the illustrated embodiment, the cap body 16 includes two apertures 28, 30. In an embodiment, the aperture 28 can be referred to as a vent. In an embodiment, the fluid stored in the inner container 13 (FIGS. 1A, 1B) may not pass through aperture 28. That is, in an embodiment, the aperture 28 is not in fluid communication with an inner volume of the inner container 13. In such an embodiment, the aperture 28 can be disposed at a location that is between container 12 (FIGS. 1A, 1B) and inner container 13. By locating the aperture 28 in such a location, the aperture 28 may be utilized to help maintain a particular pressure differential when dispensing the fluid contained within the container (e.g., the container 12). For example, air pressure from the vent 28 can be utilized to, for example, provide a force on an outer surface of the inner container 13 so that the fluid stored in the inner container 13 may be dispensed. The aperture 30 may be disposed at or about a center of the cap body 16. In an embodiment, a location of the aperture 30 may vary. The location of the aperture 30 may be based on, for example, a particular type of dispensing equipment or the like. In the illustrated embodiment, the aperture 30 and the cap body 16 are concentrically arranged. In an embodiment, the aperture 30 and the cap body 16 can be arranged other than concentrically. In an embodiment including the aperture 28, the aperture 28 may be disposed radially outward from the aperture 30. In an embodiment, the aperture 28 is relatively smaller in diameter than the aperture 30. The seal 26 is disposed such that the seal 26 prevents fluid communication across the aperture 30 until the seal 26 has been ruptured. Accordingly, the seal 26 is generally arranged such that a center of the seal 26 is aligned with a center of the aperture 30.

In an embodiment, a diameter of the cap body 16 can vary according to the container 12 (e.g., FIG. 1A) that is utilized. In an embodiment, the diameter of the cap body can be at or about 2.75 inches. It will be appreciated that the diameter can vary beyond the stated value according to the principles of this disclosure.

In an embodiment, a diameter of the aperture 30 can vary according to the cap body 16 and the container 12 (e.g., FIG. 1A) that is utilized. In an embodiment, the diameter of the aperture 30 can be at or about 0.90 inches. It will be appreciated that the diameter can vary beyond the stated value according to the principles of this disclosure.

The cap body 16 can include a plurality of alignment features 17 which can be utilized to align the cap body 16 and the key code body 18 when assembling the two components together. The key code body 18 includes a plurality of alignment features (not shown) configured to receive the alignment features 17. For example, the alignment features of the key code body 18 may be, for example, a plurality of recesses configured to receive the alignment features 17. Two alignment features 17 are shown in the illustrated embodiment. It will be appreciated that the number of alignment features 17 can be greater than two, according to an embodiment. In an embodiment, a single alignment feature 17 can be provided. A geometry of the alignment features 17 is not intended to be limited to that shown in FIG. 3 and can vary so long as a recess on the key code body 18 is configured to receive the corresponding alignment features 17.

The key code body 18 can be cylindrical, according to an embodiment. The key code body 18 can be a cylindrical ring, having opening 19 therethrough, according to an embodiment.

The removable closure member 20A can be an assembly of parts, as shown in FIG. 3. For example, the removable closure member 20A can include a closure body 32, a movable member 34, and a plug 36 secured together. In an embodiment, the plug 36 may be optional. In an embodiment, the plug 36 may serve an aesthetic appearance, but not impact a functionality of the removable closure member 20A.

The closure body 32 includes a first engagement structure 38, a first rotation stop member 40, a first surface 42A, a second surface 42B opposite the first surface 42A, a second rotation stop member 44, a securing member 46, and a dial arm 56. The first engagement structure 38 protrudes from the first surface 42A. The first engagement structure 38 includes an engagement surface 38A. The engagement surface 38A is insertable below a shoulder (see shoulder 55 in FIG. 5) of the key code body 18. The engagement surface 38A can contact the shoulder (see shoulder 55 in FIG. 5) to provide a connecting force to maintain the removable closure member 20A in the engaged state. The dial arm 56 is secured to the closure body 32 via the securing member 46. The securing member 46 can, for example, receive the dial arm 56 and secure the dial arm 56 to the closure body 32. The securing member 46 can hold the dial arm 56 in a manner such that rotation of the arm is permitted. A connection between the dial arm 56 and the securing member 46 can be, for example, a snap fit connection.

The first rotation stop member 40 and the second rotation stop member 44 constrain an area between which the dial arm 56 can rotate. In an embodiment, the first rotation stop member 40 and the second rotation stop member 44 may protrude from the first surface 42A. The dial arm 56 can rotate about a rotational axis A-A'. The extent of the rotation is between the first rotation stop member 40 and the second rotation stop member 44.

The cap 14A also includes a first seal 48 and a second seal 50. The first seal 48 and the second seal 50 can, for example, be an O-ring type seal. In an embodiment, the first seal 48 and the second seal 50 can be secured to the second surface 42B of the removable closure member 20A. In an embodiment, the first seal 48, the second seal 50, or both the first seal 48 and the second seal 50, can be fixed to the cap body 16. The first seal 48 is generally designed to provide a sealing connection to the cap body 16. The second seal 50 is generally designed to provide a sealing connection to the cap body 16.

Figure 4:
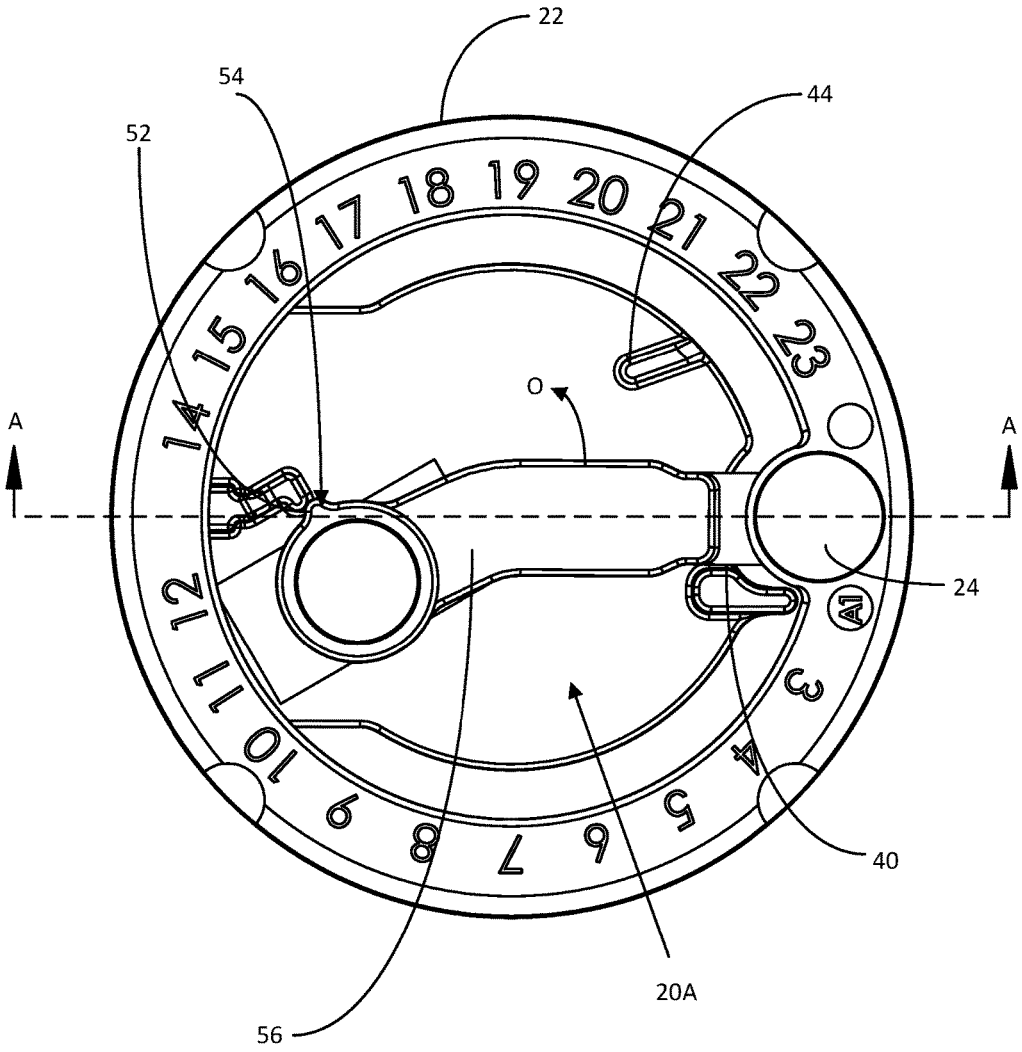
FIG. 4 is a top view of the cap of FIG. 2 for a fluid containment system, according to an embodiment.

FIG. 4 is a top view of the cap of FIG. 2 for a fluid containment system, according to an embodiment. Features of FIG. 4 can be the same as or similar to features of FIGS. 1A-3. For simplicity of this disclosure, features which have previously been described will not be described in additional detail.

As shown in FIG. 4, the removable closure member 20A is in an engaged state. In the engaged state, the rotating dial arm 56 of the removable closure member 20A abuts the first rotation stop member 40. In an embodiment, the rotating dial arm 56 of the removable closure member 20A contacts at least a portion of the first rotation stop member 40 in the engaged state. In an unengaged state, the rotating dial arm 56 of the removable closure member 20A would be rotated in a direction O until the rotating dial arm 56 of the removable closure member 20A abuts the second rotation stop member 44. It will be appreciated that in the unengaged state, the rotating dial arm 56 of the removable closure member 20A may not be abutting or in contact with the second rotation stop member 44. For example, in the unengaged state, the rotating dial arm 56 of the removable closure member 20A may be rotated to a location between the first rotation stop member 40 and the second rotation stop member 44.

FIG. 4 additionally shows detent mechanism 52. The detent mechanism 52 is part of the first engagement structure 38 in the illustrated embodiment. It will be appreciated that the detent mechanism 52 can be a separate protrusion from the first surface 42A. The detent mechanism 52 and a protrusion 54 from the rotating dial arm 56 of the removable closure member 20A can collectively maintain the rotating dial arm 56 of the removable closure member 20A in the engaged state. In an embodiment, the protrusion 54 includes a portion of material that extends relatively further from the axis A-A' of the movable member 34 than a remaining portion of the material.

Figure 5:
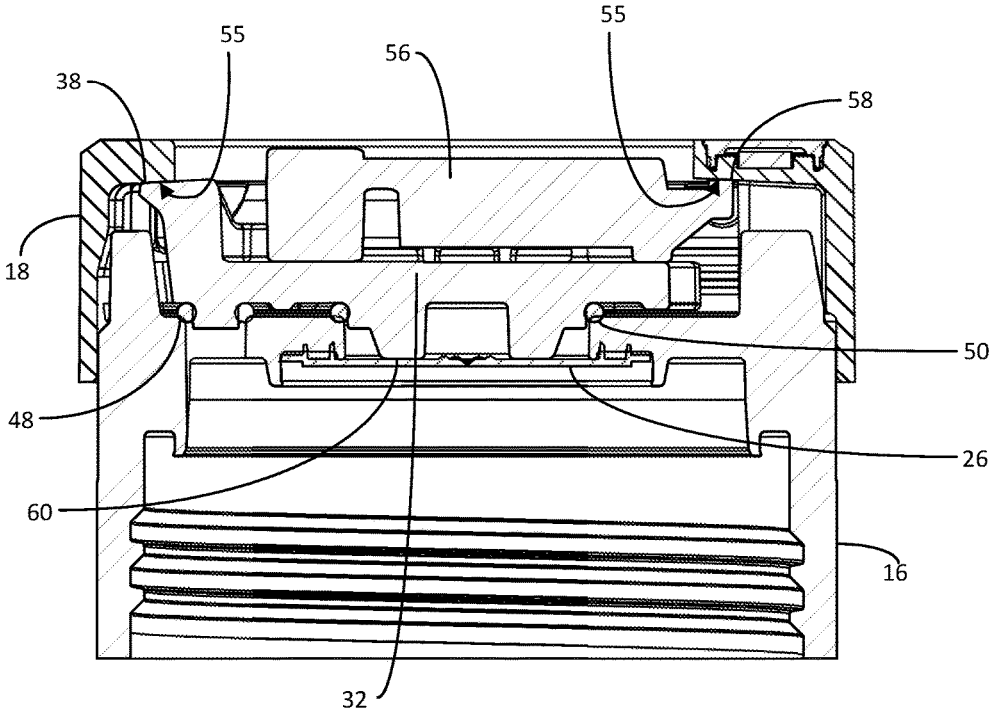
FIG. 5 is a sectional view of the cap of FIG. 2 taken along line A-A in FIG. 4 for a fluid containment system, according to an embodiment.

FIG. 5 is a sectional view of the cap of FIG. 2 taken along line A-A in FIG. 4 for a fluid containment system, according to an embodiment. Features of FIG. 5 can be the same as or similar to features of FIGS. 1A-4. For simplicity of this disclosure, features which have previously been described will not be described in additional detail.

In FIG. 5, the removable closure member 20A is in the engaged state. In the engaged state the first engagement structure 38 abuts shoulder 55 of the key code ring 22. In the engaged state, a dial arm 56 of the removable closure member 20A extends such that a second engagement structure 58 abuts the shoulder 55. In the engaged state, the removable closure member 20A generally extends across a diameter of the key code body 18. In an embodiment, a protrusion 60 extends from the second surface 42B toward the cap body 16. As shown in the illustrated embodiment, the protrusion 60 abuts the seal 26. By abutting the seal 26, in a situation in which fluid may be directed toward the seal 26 such as, but not limited to, if the container (e.g., container 12) on which the cap is installed is turned upside down or falls from a height and hits the ground, the protrusion 60 provides additional sealing pressure to aid in preventing the seal 26 from rupturing in such an unwanted situation. For example, if the fluid containment system 10 falls toward the ground, with the cap 14A contacting the ground first, a force of fluid can be provided against the seal 26. In such a scenario, the force of the fluid may be sufficient to rupture the seal 26. However, by locating the protrusion 60 such that it abuts the seal 26, in such a scenario, the protrusion 60 can provided an additional support to prevent the seal 26 from rupturing.

Figure 6A:
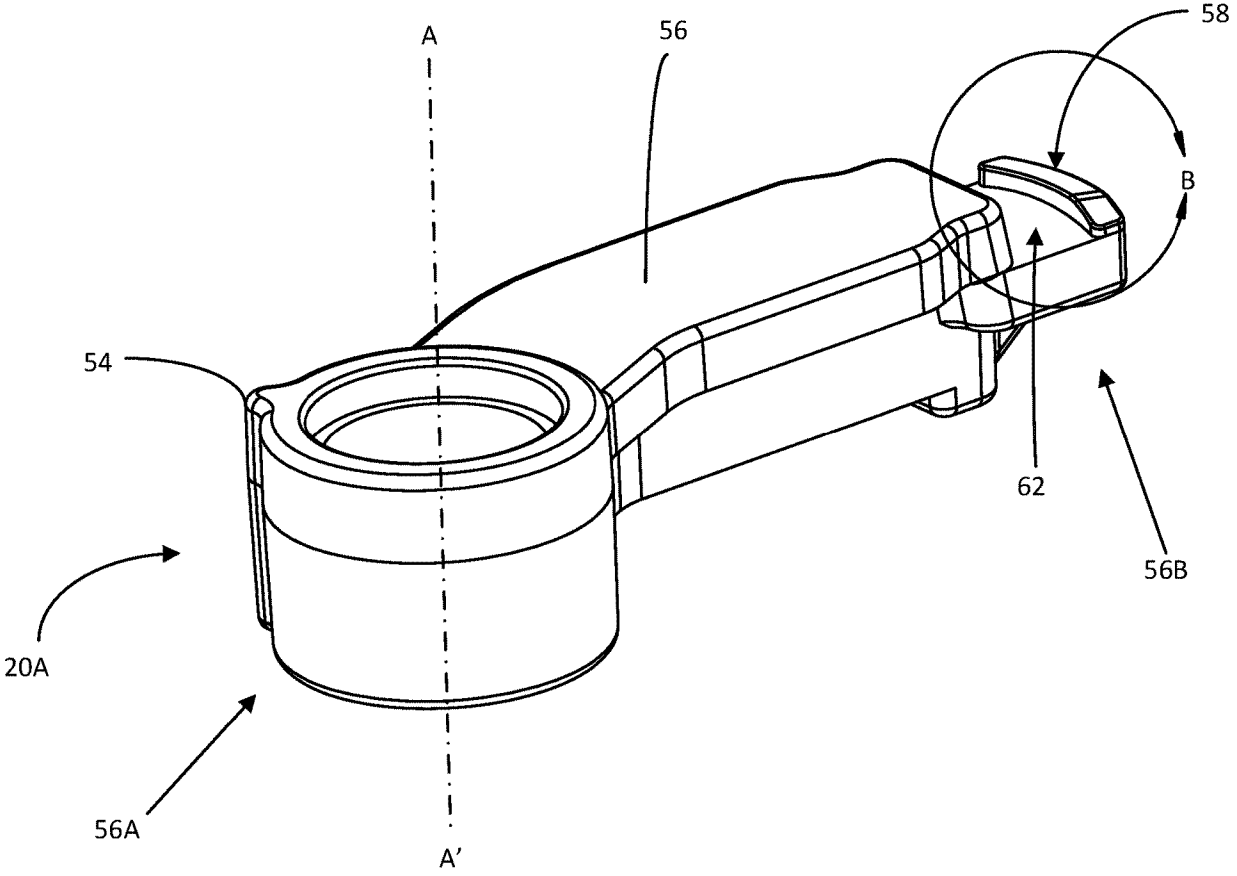
FIGS. 6A and 6B are perspective views of a dial arm for the cap of FIG. 2 for a fluid containment system, according to an embodiment.
Figure 6B:
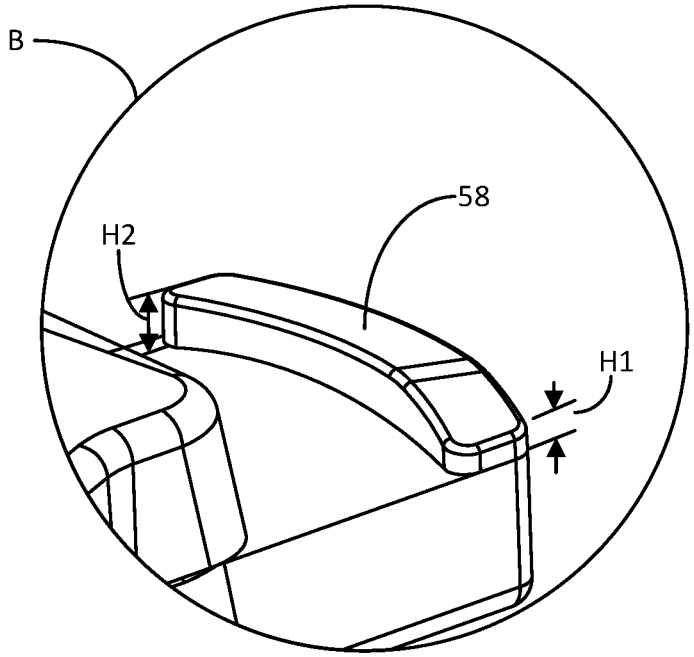

FIGS. 6A and 6B are perspective views of the dial arm 56 for the cap 14A of FIG. 2 for a fluid containment system, according to an embodiment. Features of FIGS. 6A and 6B can be the same as or similar to features of FIGS. 1A-5. For simplicity of this disclosure, features which have previously been described will not be described in additional detail.

As shown in FIG. 6A, the dial arm 56 includes a first end 56A and a second end 56B opposite the first end 56A. The first end 56A includes the rotational axis A-A' about which the dial arm 56 can rotate when installed on the securing member 46. The first end 56A of the dial arm 56 can include a cylindrical geometry. The first end 56A of the arm includes the protrusion 54, which through engagement with detent mechanism 52 can maintain the dial arm 56 in the engaged state. As shown in FIGS. 6A and 6B, the second end 56B of the dial arm 56 includes the second engagement structure 58. The second end 56B also includes a recessed portion 62. The recessed portion 62 is a portion that can have a portion of material removed from the dial arm 56. The recessed portion 62 can enable the dial arm 56 to be received under the shoulder 55 of the key code ring 22. The second engagement structure 58 is in a form of a ramped protrusion. That is, as shown in FIG. 6B, the protrusion has a first height H1 at one end of the second engagement structure 58 and a second height H2 at an opposite end along a perimeter of the dial arm 56. In the illustrated embodiment, the first height H1 is relatively less than the second height H2. The variation in height between the two ends of the second engagement structure 58 can reduce an amount of effort to move the dial arm 56 between the engaged state and the unengaged state.

Figure 7:
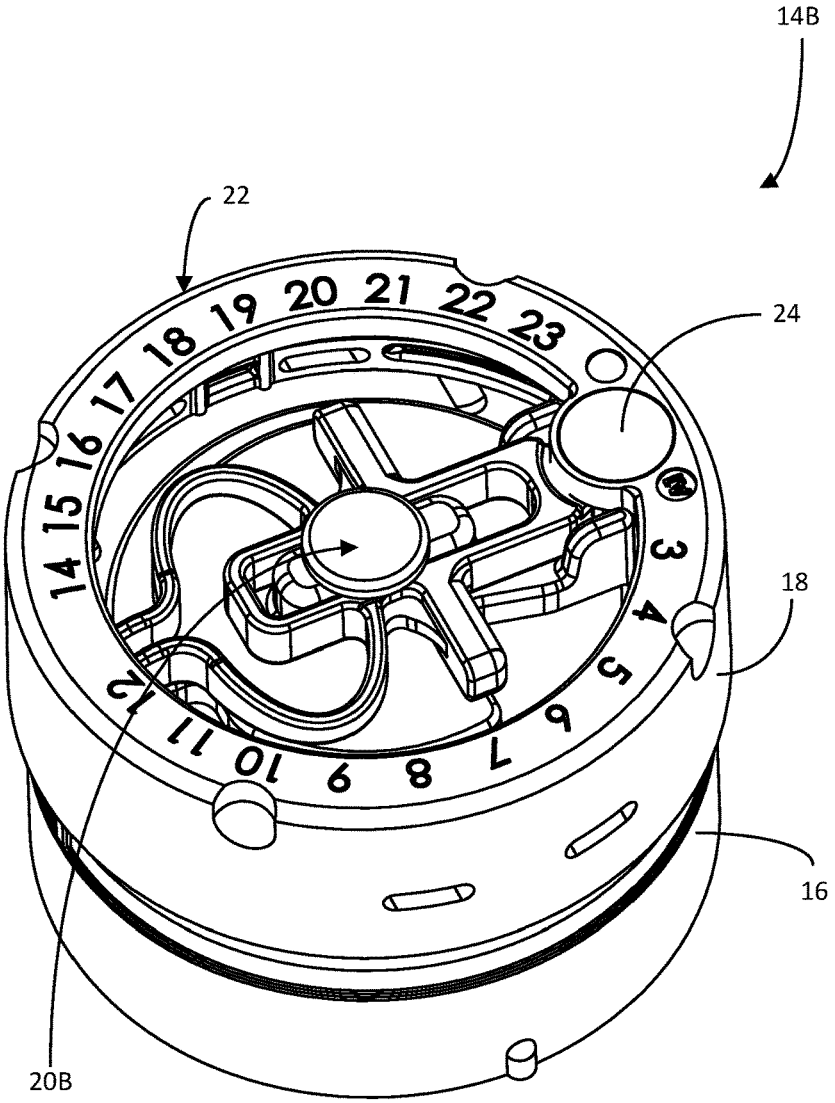
FIG. 7 is a perspective view of a cap for a fluid containment system, according to an embodiment.

FIG. 7 is a perspective view of a cap 14B for a fluid containment system (e.g., the fluid containment system 10 in FIGS. 1A, 1B), according to an embodiment. Features of FIG. 7 can be the same as or similar to features of FIGS. 1-6B. For simplicity of this disclosure, features which have previously been described will not be described in additional detail.

Generally, those of ordinary skill in the art with knowledge of this disclosure will recognize that the removable closure member can take various forms as long as the removable closure member includes engaging and sealing features in accordance with the principles of this disclosure.

FIG. 7 varies from FIGS. 2-6B by including a removable closure member 20B that is an alternative to the removable closure member 20A. In the illustrated embodiment, the removable closure member 20B is shown in the engaged state. In the engaged state, the removable closure member 20B may be inserted in a central area of the key code body 18, thereby forming a sealing connection with the key code body 18. The removable closure member 20B is discussed in additional detail in accordance with FIGS. 8-11 below.

Figure 8:
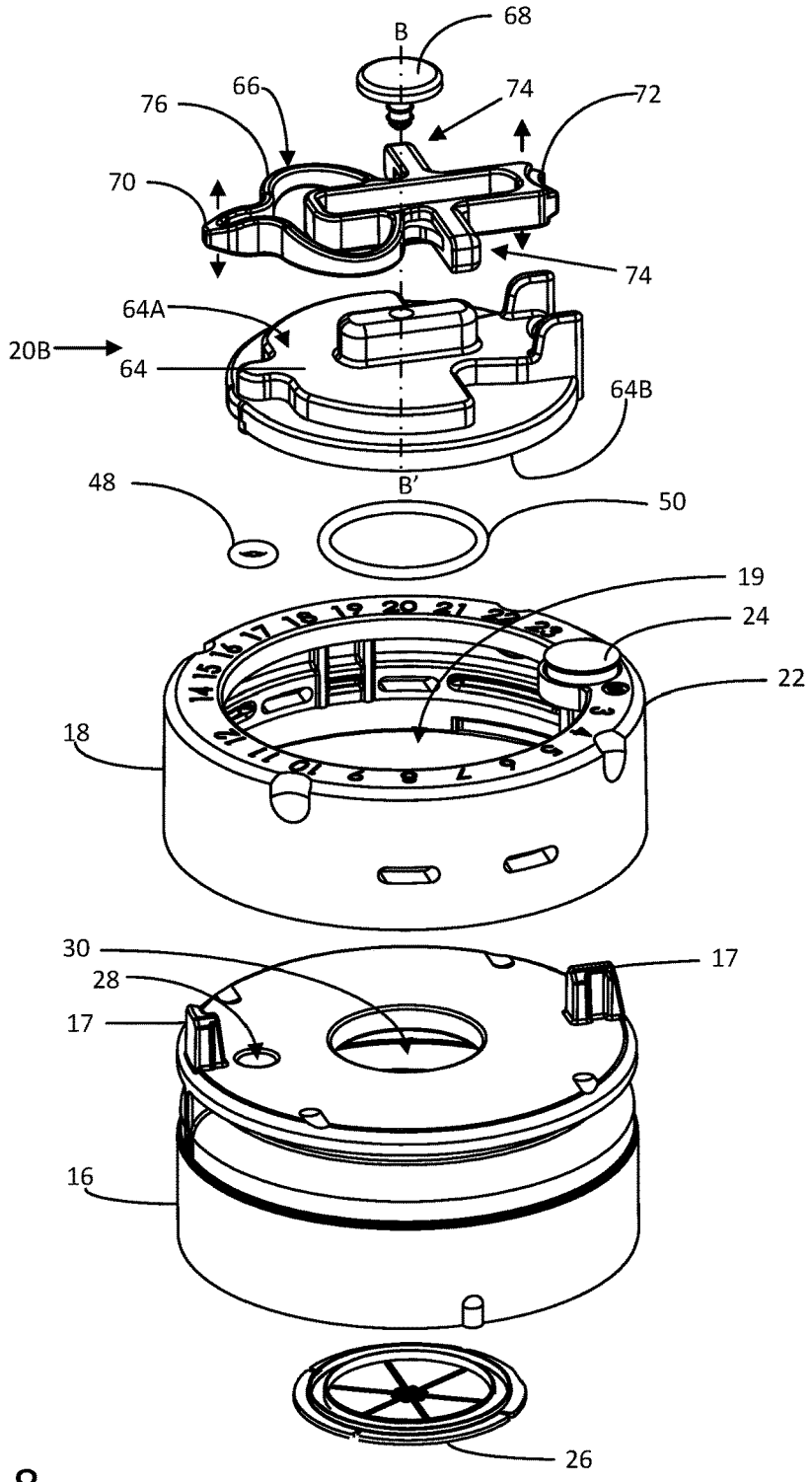
FIG. 8 is an exploded perspective view of the cap of FIG. 7 for a fluid containment system, according to an embodiment.

FIG. 8 is an exploded perspective view of the cap 14B of FIG. 7 for a fluid containment system (e.g., the fluid containment system 10 in FIGS. 1A, 1B), according to an embodiment. Features of FIG. 8 can be the same as or similar to features of FIGS. 1A-7. For simplicity of this disclosure, features which have previously been described will not be described in additional detail.

The removable closure member 20B can be an assembly of parts, as shown in FIG. 8. For example, the removable closure member 20B can include a closure body 64, a movable member 66, and a retainer 68. The retainer 68 can secure the movable member 66 to the closure body 64. The retainer 68 can maintain the connection in such a manner that the movable member 66 can be movable about the closure body 64. The closure body 64 includes a first surface 64A and a second surface 64B opposite the first surface 64A. The movable member 66 includes a first engagement structure 70, a second engagement structure 72, a plurality of fixed members 74, and a flexible member 76. In an embodiment, the flexible member 76 can be elliptical in geometry. The elliptical geometry can, for example, enable compression of the flexible member 76 to switch between the engaged state and the unengaged state. In the engaged state, the first engagement structure 70 and the second engagement structure 72 can contact a shoulder 55 (see FIG. 10) to provide a connecting force to maintain the removable closure member 20B in the engaged state. In operation, the first and second engagement structures 70, 72 can slide relative to the first surface 64A. This can, for example, allow the first and second engagement structures 70, 72 to move up/down (relative to the page in the illustration, relative to the base surface 16A of the cap body 16 in practice). The fixed members 74 and the flexible member 76 can be used to secure the removable closure member 20B in place. In operation, a user may utilize the fixed members 74 to place the user's fingers, enabling the user to compress the flexible member 76 toward the first engagement structure 70 to release the second engagement structure 72 from the shoulder 55. In operation, the compression can be in a direction that is toward a longitudinal axis B-B' of the cap 14B.

Figure 9:
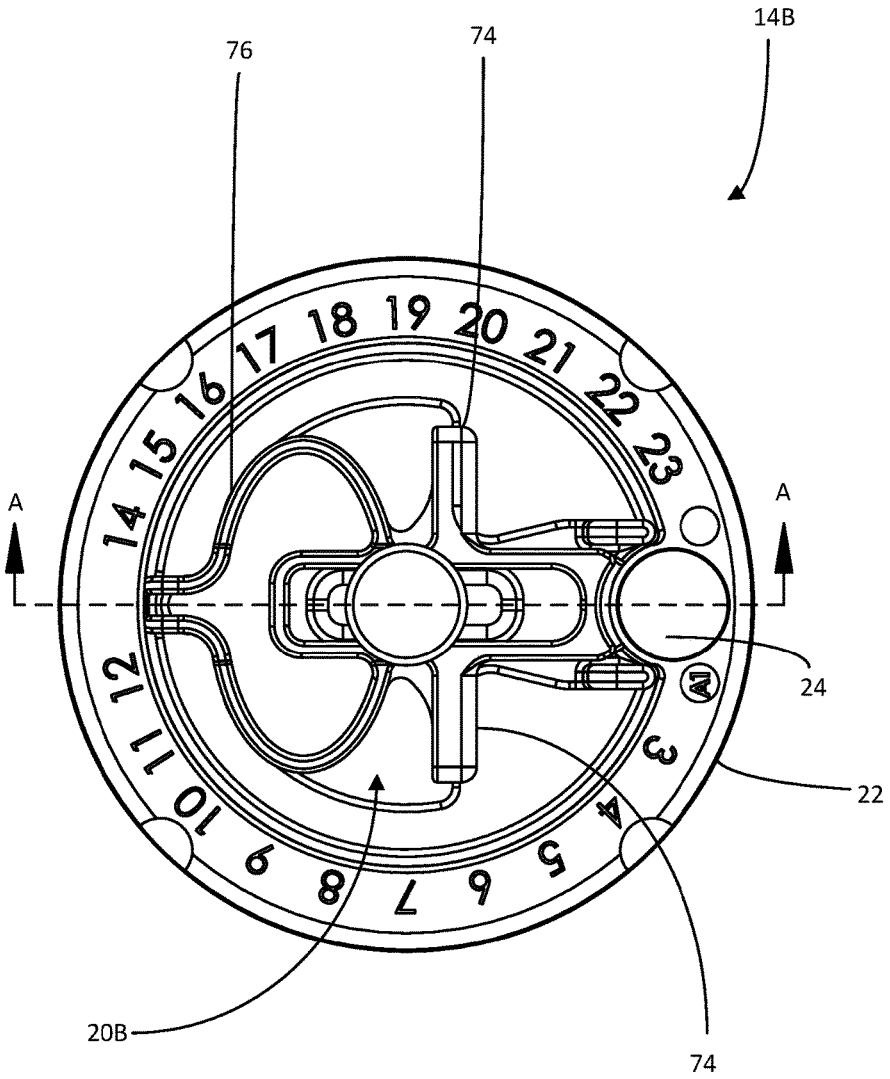
FIG. 9 is a top view of the cap of FIG. 7 for a fluid containment system, according to an embodiment.

FIG. 9 is a top view of the cap of FIG. 7 for a fluid containment system, according to an embodiment. Features of FIG. 9 can be the same as or similar to features of FIGS. 1A-8. For simplicity of this disclosure, features which have previously been described will not be described in additional detail.

The removable closure member 20B is illustrated in the engaged state in FIG. 9. To remove the removable closure member 20B from the cap 14B (e.g., switch between the engaged state and the unengaged state), the user can force the flexible member 76 in a leftward direction with respect to the page (e.g., toward the longitudinal axis of the cap 14B).

Figure 10:
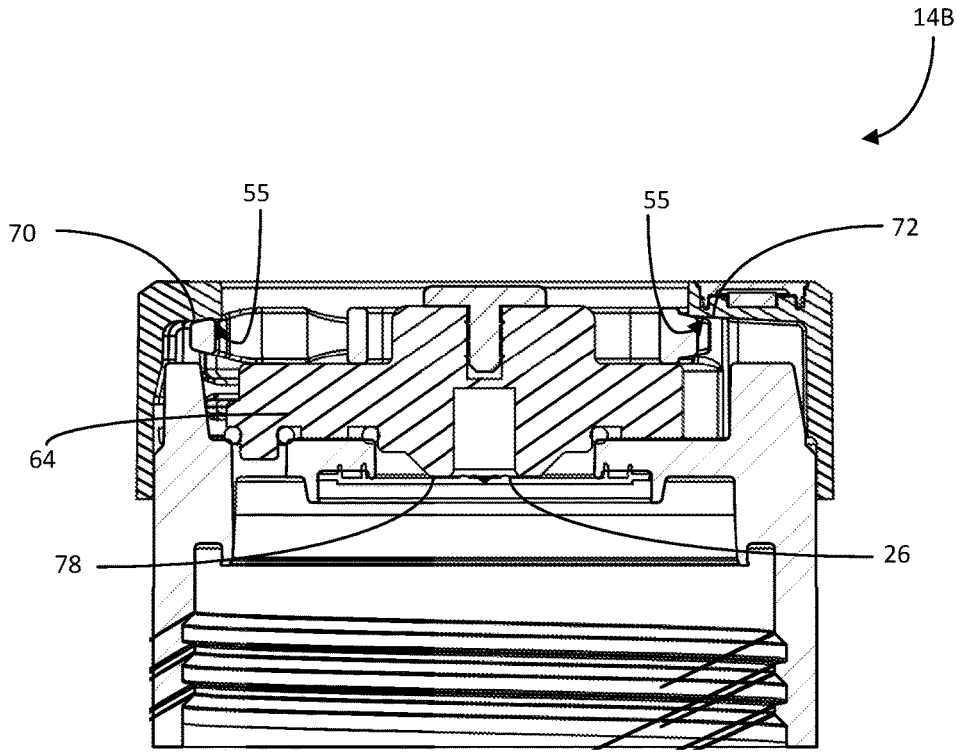
FIG. 10 is a sectional view of the cap of FIG. 7 taken along line A-A in FIG. 9 for a fluid containment system, according to an embodiment.

FIG. 10 is a sectional view of the cap of FIG. 7 taken along line A-A in FIG. 9 for a fluid containment system, according to an embodiment. Features of FIG. 10 can be the same as or similar to features of FIGS. 1A-9. For simplicity of this disclosure, features which have previously been described will not be described in additional detail.

In FIG. 10, the removable closure member 20B is in the engaged state. In the engaged state the first engagement structure 70 abuts shoulder 55 of the key code ring 22. In the engaged state, the second engagement structure 72 also abuts the shoulder 55. In the engaged state, the removable closure member 20B generally extends across a diameter of the key code body 18. In an embodiment, a protrusion 78 extends from the second surface 64B toward the cap body 16. As shown in the illustrated embodiment, the protrusion 78 abuts the seal 26. By abutting the seal 26, in a situation in which fluid may be directed toward the seal 26 such as, but not limited to, if the container (e.g., container 12) on which the cap is installed is turned upside down or falls from a height and hits the ground, the protrusion 78 provides additional sealing pressure to aid in preventing the seal 26 from rupturing in such an unwanted situation.

Figure 11:
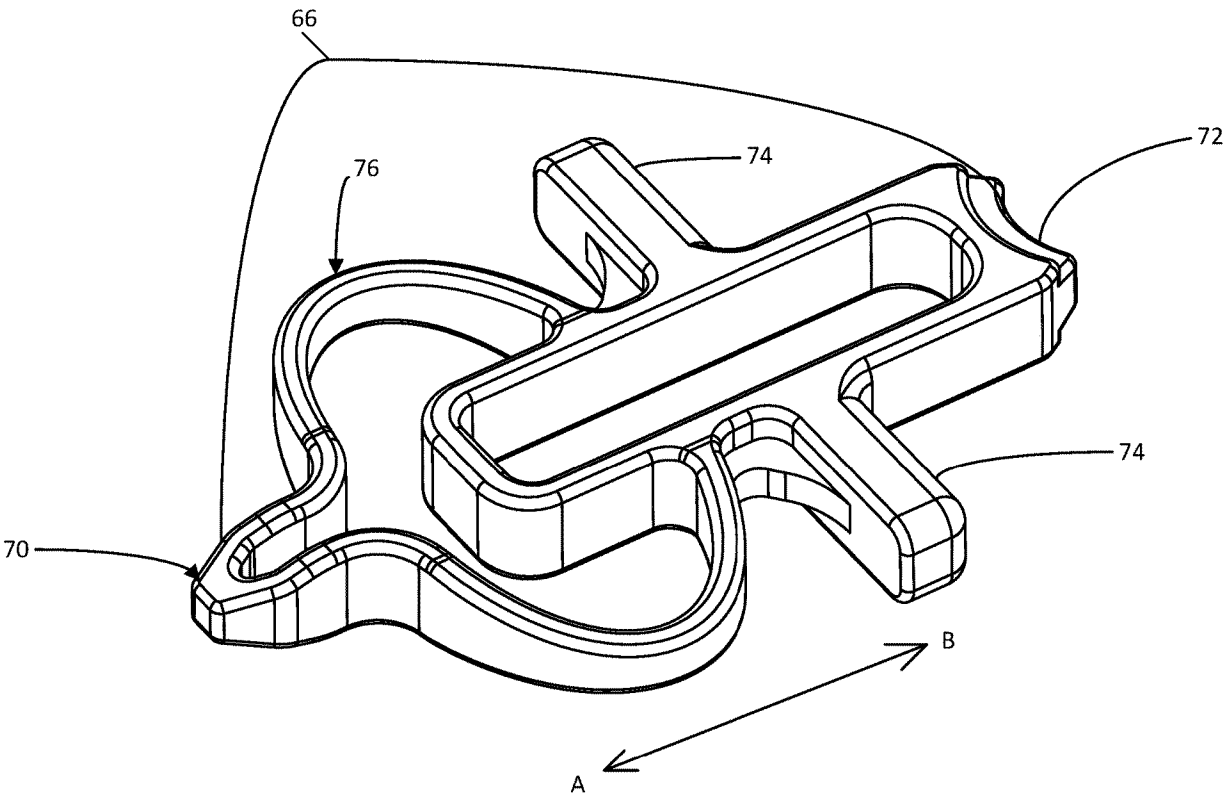
FIG. 11 is a perspective view of a securing mechanism for the cap of FIG. 7 for a fluid containment system, according to an embodiment.

FIG. 11 is a perspective view of a securing mechanism for the cap of FIG. 7 for a fluid containment system, according to an embodiment. Features of FIG. 11 can be the same as or similar to features of FIGS. 1A-10. For simplicity of this disclosure, features which have previously been described will not be described in additional detail.

As shown in FIG. 11, the movable member 66 includes the first engagement structure 70 at a first end of the movable member 66 and the second engagement structure 72 oppositely disposed at a second end of the movable member 66. The flexible member 76 can be compressed in a direction A, or uncompressed in a direction B. The fixed members 74 provide a holding point which can be used to enable compression of the flexible member 76.

Aspects:

It is noted that any one of aspects 1-10 can be combined with any one of aspects 11 19, 20-23, 24, or 25. Any one of aspects 11-19 can be combined with any one of aspects 20 23, 24, or 25. Any one of aspects 20-23 can be combined with one of aspects 24 or 25.

Aspect 1. A cap for a fluid container, comprising:

a cap body including a base surface at a first end and an opening at a second end, the cap body having a first diameter, the cap body being engageable with the fluid container, the base surface including a first engagement structure protruding in a longitudinal direction from the base surface, the cap including a first aperture in the base surface;

a key code body, the key code body including a second engagement structure engageable with the first engagement structure that secures the key code body to the cap body in a engaged state, the key code body including a key code ring at a first end of the key code body, the key code ring including a shoulder such that a portion of the key code ring is disposed spaced from the base surface when the cap body and the key code body are in the engaged state, the portion of the key code ring that is spaced from the base surface including a first surface; and a removable closure member including a plurality of engagement surfaces and a sealing surface disposed opposite the plurality of engagement surfaces, wherein the plurality of engagement surfaces are engageable with the first surface to provide a closing force that maintains the sealing surface in engagement with the base surface in the engaged state, the removable closure member including a sealing mechanism including a sealing member on the sealing surface, the sealing member being engageable with a portion of the base surface that defines the first aperture.

Aspect 2. The cap according to aspect 1, further comprising a second aperture in the base surface, the second aperture being disposed radially outward from the first aperture.

Aspect 3. The cap according to aspect 1 or 2, wherein the closure member includes a body insertable into the key code ring, the body including the sealing surface and a surface opposite the sealing surface, wherein a first of the plurality of engagement surfaces is a fixed protrusion that extends from the surface opposite the sealing surface.

Aspect 4. The cap according to aspect 3, wherein at least one of the plurality of engagement surfaces is movable relative to the body of the closure member.

Aspect 5. The cap according to aspect 3, wherein in the engaged state, the first of the plurality of engagement surfaces and a second of the plurality of engagement surfaces are disposed in a line along a diameter of the key code body.

Aspect 6. The cap according to aspect 5, wherein in an unengaged state, the first of the plurality of engagement surfaces and the second of the plurality of engagement surfaces are not aligned along the diameter of the key code body.

Aspect 7. The cap according to any one of aspects 1-6, wherein the closure member includes a body insertable into the key code ring and a flexible member, the flexible member being compressible in a direction toward a longitudinal axis of the cap body.

Aspect 8. The cap according to any one of aspects 1-7, wherein the key code body further comprises a magnet disposed in the key code ring.

Aspect 9. The cap according to any one of aspects 1-8, further comprising a seal that seals the first aperture, wherein the seal is a rupturable membrane.

Aspect 10. The cap according to aspect 9, wherein a protrusion from the sealing surface abuts the rupturable membrane in the engaged state.

Aspect 11. A containment system for containing a liquid, comprising:

a container configured to store a fluid; and a cap engageable with the container, including:

a cap body including a base surface at a first end and an opening at a second end, the cap body having a first diameter, the cap body being engageable with the fluid container, the base surface including a first engagement structure protruding in a longitudinal direction from the base surface, the cap including a first aperture in the base surface;

a key code body, the key code body including a second engagement structure engageable with the first engagement structure that secures the key code body to the cap body in an engaged state, the key code body including a key code ring at a first end of the key code body, the key code ring including a shoulder such that a portion of the key code ring is disposed spaced from the base surface when the cap body and the key code body are in the engaged state, the portion of the key code ring that is spaced from the base surface including a first surface; and a removable closure member including a plurality of engagement surfaces and a sealing surface disposed opposite the plurality of engagement surfaces, wherein the plurality of engagement surfaces are engageable with the first surface to provide a closing force that maintains the sealing surface in engagement with the base surface in the engaged state, the removable closure member including a sealing mechanism including a sealing member on the sealing surface, the sealing member being engageable with a portion of the base surface that defines the first aperture.

Aspect 12. The containment system according to aspect 11, wherein the container further comprises a liner for storing the fluid.

Aspect 13. The containment system according to aspect 11 or 12, wherein the cap is engageable with a dispensing assembly for receiving a connector from the dispensing assembly to dispense the fluid.

Aspect 14. The containment system according to aspect 13, wherein the closure member is removed in a dispensing configuration.

Aspect 15. The containment system according to any one of aspects 11-14, wherein the cap further comprises a seal that seals the first aperture.

Aspect 16. The containment system according to aspect 15, wherein the seal that seals the first aperture is a rupturable membrane.

Aspect 17. The containment system according to any one of aspects 11-16, wherein the closure member is disposed entirely between the key code ring and the base surface.

Aspect 18. The containment system according to any one of aspects 11-17, wherein the closure member includes a body insertable into the key code ring, the body including the sealing surface and a surface opposite the sealing surface, wherein at least one of the plurality of engagement surfaces is movable relative to the body of the closure member.

Aspect 19. The containment system according to any one of aspects 15-18, wherein a protrusion from the sealing surface abuts the rupturable membrane in the engaged state.

Aspect 20. A fluid storage kit, comprising:

a containment system for containing a liquid, comprising:

a container configured to store a fluid; and a cap engageable with the container, including:

a cap body including a base surface at a first end and an opening at a second end, the cap body having a first diameter, the cap body including threads on an interior surface of the cap body, the threads being engageable with external threads of the fluid container, the threads disposed between the second end and the first end, the base surface including a first engagement structure protruding in a longitudinal direction from the base surface, the cap including a first aperture in the base surface;

a key code body having a second diameter that is larger than the first diameter, the key code body including a second engagement structure engageable with the first engagement structure that secures the key code body to the cap body in an engaged state, the key code body including a key code ring at a first end of the key code body, the key code ring including a shoulder such that a portion of the key code ring is disposed spaced from the base surface when the cap body and the key code body are in the engaged state, the portion of the key code ring that is spaced from the base surface including a first surface; and a removable closure member including a plurality of engagement surfaces and a sealing surface disposed opposite the plurality of engagement surfaces, wherein the plurality of engagement surfaces are engageable with the first surface to provide a closing force that maintains the sealing surface in engagement with the base surface in the engaged state.

Aspect 21. The fluid storage kit according to aspect 20, further comprising a fluid liner insertable into the container.

Aspect 22. The fluid storage kit according to aspect 20 or 21, wherein the cap is selected for storing a particular fluid.

Aspect 23. The fluid storage kit according to any one of aspects 20-22, wherein the closure member includes a body insertable into the key code ring, the body including the sealing surface and a surface opposite the sealing surface, wherein at least one of the plurality of engagement surfaces is movable relative to the body of the closure member.

Aspect 24. A method of assembling the containment system for containing a liquid of aspect 11, comprising:

engaging a first of the plurality of engagement surfaces with the first surface of the key code body, the first of the plurality of engagement surfaces being fixed; and engaging a second of the plurality of engagement surface with the first surface of the key code body, the second of the plurality of engagement surfaces being movable, whereby the engaging induces the closing force thereby allowing the sealing surface to be engaged with the base surface.

Aspect 25. The method according to aspect 24, further comprising:

disengaging the second of the plurality of engagement surfaces from the first surface of the key code body;

disengaging the first of the plurality of surfaces from the first surface; and removing the closure member.

The terminology used in this specification is intended to describe particular embodiments and is not intended to be limiting. The terms "a," "an," and "the" include the plural forms as well, unless clearly indicated otherwise. The terms "comprises" and "comprising," when used in this specification, specify the presence of the stated features, integers, steps, operations, elements, or components, but do not preclude the presence or addition of one or more other features, integers, steps, operations, elements, or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A cap for a fluid container, comprising:

a cap body including a base surface at a first end and an opening at a second end, the cap body being engageable with the fluid container, the base surface including a first engagement structure protruding in a longitudinal direction from the base surface, the cap including a first aperture in the base surface;

a key code body, the key code body including a second engagement structure engageable with the first engagement structure that secures the key code body to the cap body in an engaged state, the key code body including a key code ring at a first end of the key code body, the key code ring including a shoulder such that a portion of the key code ring is disposed spaced from the base surface when the cap body and the key code body are in the engaged state, the portion of the key code ring that is spaced from the base surface including a first surface; and a removable closure member including a plurality of engagement surfaces and a sealing surface disposed opposite the plurality of engagement surfaces, wherein the plurality of engagement surfaces are engageable with the first surface to provide a closing force that maintains the sealing surface in engagement with the base surface in the engaged state, the removable closure member including a sealing mechanism including a sealing member on the sealing surface, the sealing member being engageable with a portion of the base surface that defines the first aperture.

2. The cap according to claim 1, further comprising a second aperture in the base surface, the second aperture being disposed radially outward from the first aperture.

3. The cap according to claim 1, wherein the closure member includes a body insertable into the key code ring, the body including the sealing surface and a surface opposite the sealing surface, wherein a first of the plurality of engagement surfaces is a fixed protrusion that extends from the surface opposite the sealing surface.

4. The cap according to claim 3, wherein at least one of the plurality of engagement surfaces is movable relative to the body of the closure member.

5. The cap according to claim 3, wherein in the engaged state, the first of the plurality of engagement surfaces and a second of the plurality of engagement surfaces are disposed in a line along a diameter of the key code body.

6. The cap according to claim 5, wherein in an unengaged state, the first of the plurality of engagement surfaces and the second of the plurality of engagement surfaces are not aligned along the diameter of the key code body.

7. The cap according to claim 1, wherein the closure member includes a body insertable into the key code ring and a flexible member, the flexible member being compressible in a direction toward a longitudinal axis of the cap body.

8. The cap according to claim 1, wherein the cap body is cylindrical.

9. The cap according to claim 1, further comprising a seal that seals the first aperture, the seal being a rupturable membrane, wherein a protrusion from the sealing surface abuts the rupturable membrane in the engaged state.

10. A containment system for containing a liquid, comprising:

a container configured to store a fluid; and a cap engageable with the container, including:

a cap body including a base surface at a first end and an opening at a second end, the cap body including threads on an interior surface of the cap body, the threads being engageable with external threads of the fluid container, the threads disposed between the second end and the first end, the base surface including a first engagement structure protruding in a longitudinal direction from the base surface, the cap including a first aperture in the base surface;

a key code body, the key code body including a second engagement structure engageable with the first engagement structure that secures the key code body to the cap body in an engaged state, the key code body including a key code ring at a first end of the key code body, the key code ring including a shoulder such that a portion of the key code ring is disposed spaced from the base surface when the cap body and the key code body are in the engaged state, the portion of the key code ring that is spaced from the base surface including a first surface; and a removable closure member including a plurality of engagement surfaces and a sealing surface disposed opposite the plurality of engagement surfaces, wherein the plurality of engagement surfaces are engageable with the first surface to provide a closing force that maintains the sealing surface in engagement with the base surface in the engaged state.

11. The containment system according to claim 10, wherein the container further comprises a liner for storing the fluid.

12. The containment system according to claim 10, wherein the cap is engageable with a dispensing assembly for receiving a connector from the dispensing assembly to dispense the fluid.

13. The containment system according to claim 12, wherein the closure member is removed in a dispensing configuration.

14. The containment system according to claim 10, wherein the cap further comprises a seal that seals the first aperture, wherein the seal is a rupturable membrane, a protrusion from the sealing surface abuts the rupturable membrane in the engaged state.

15. The containment system according to claim 10, wherein the closure member is disposed entirely between the key code ring and the base surface.

16. The containment system according to claim 10, wherein the closure member includes a body insertable into the key code ring, the body including the sealing surface and a surface opposite the sealing surface, wherein at least one of the plurality of engagement surfaces is movable relative to the body of the closure member.

17. A fluid storage kit, comprising:

a containment system for containing a liquid, comprising:

a container configured to store a fluid; and a cap engageable with the container, including:

a cap body including a base surface at a first end and an opening at a second end, the cap body including threads on an interior surface of the cap body, the threads being engageable with external threads of the fluid container, the threads disposed between the second end and the first end, the base surface including a first engagement structure protruding in a longitudinal direction from the base surface, the cap including a first aperture in the base surface;

a key code body, the key code body including a second engagement structure engageable with the first engagement structure that secures the key code body to the cap body in an engaged state, the key code body including a key code ring at a first end of the key code body, the key code ring including a shoulder such that a portion of the key code ring is disposed spaced from the base surface when the cap body and the key code body are in the engaged state, the portion of the key code ring that is spaced from the base surface including a first surface; and a removable closure member including a plurality of engagement surfaces and a sealing surface disposed opposite the plurality of engagement surfaces, wherein the plurality of engagement surfaces are engageable with the first surface to provide a closing force that maintains the sealing surface in engagement with the base surface in the engaged state.

18. The fluid storage kit according to claim 17, further comprising a fluid liner insertable into the container.

19. The fluid storage kit according to claim 17, wherein the cap is configured for storing a particular fluid.

20. The fluid storage kit according to claim 17, wherein the closure member includes a body insertable into the key code ring, the body including the sealing surface and a surface opposite the sealing surface, wherein at least one of the plurality of engagement surfaces is movable relative to the body of the closure member.

* * * * *